US011701289B2

(12) United States Patent
Song et al.

(10) Patent No.: US 11,701,289 B2
(45) Date of Patent: Jul. 18, 2023

(54) METHOD FOR MANUFACTURING AND CONTROLLING REHABILITATION GLOVE BASED ON BIDIRECTIONAL DRIVER OF HONEYCOMB IMITATING STRUCTURE

(71) Applicant: SOUTHEAST UNIVERSITY, Nanjing (CN)

(72) Inventors: Aiguo Song, Nanjing (CN); Jianwei Lai, Nanjing (CN); Huijun Li, Nanjing (CN); Hong Zeng, Nanjing (CN); Baoguo Xu, Nanjing (CN); Ting Wu, Nanjing (CN)

(73) Assignee: SOUTHEAST UNIVERSITY, Jiangsu (CN)

( * ) Notice: Subject to any disclaimer, the term of this patent is extended or adjusted under 35 U.S.C. 154(b) by 0 days.

(21) Appl. No.: 17/792,316

(22) PCT Filed: Jan. 6, 2022

(86) PCT No.: PCT/CN2022/070410

§ 371 (c)(1),
(2) Date: Jul. 12, 2022

(87) PCT Pub. No.: WO2023/015838

PCT Pub. Date: Feb. 16, 2023

(65) Prior Publication Data

US 2023/0139608 A1 May 4, 2023

(30) Foreign Application Priority Data

Aug. 9, 2021 (CN) ..... 202110906642.8

(51) Int. Cl.
*A61H 1/00* (2006.01)
*A61H 1/02* (2006.01)

(52) U.S. Cl.
CPC ... *A61H 1/0285* (2013.01); *A61H 2201/0103* (2013.01); *A61H 2201/1238* (2013.01);
(Continued)

(58) Field of Classification Search
CPC ..... A61H 1/0285; A61H 2201/0103; A61H 2201/1238; A61H 2201/1635;
(Continued)

(56) References Cited

U.S. PATENT DOCUMENTS 10,449,677 B1 * 10/2019 Al Najjar ..... B25J 9/0006
10,974,382 B2 * 4/2021 Lessing ..... B25J 15/0616
(Continued)

FOREIGN PATENT DOCUMENTS

CN 106309083 A 1/2017
CN 109938968 A 6/2019
(Continued)

OTHER PUBLICATIONS

Machine translation of Written Description and Claims for CN211797581U (Year: 2020).*

*Primary Examiner* — Philip R Wiest
*Assistant Examiner* — Tyler A Raubenstraw
(74) *Attorney, Agent, or Firm* — Muncy, Geissler, Olds & Lowe, P.C.

(57) ABSTRACT

A rehabilitation glove based on a bidirectional driver of a honeycomb imitating structure, including five bidirectional drivers and a cotton glove. The drivers are fixed to a back of the glove through hook and loop fasteners. Each driver includes a hollow buckling air bag in a continuous bent state, a middle guide layer in a continuous bent state and a hollow stretching air bag. The buckling air bag and the middle guide layer are symmetrically arranged, and the stretching air bag in a straightened state is arranged below the middle guide layer. A novel bidirectional driver of a honeycomb imitating
(Continued)

structure is provided, which may provide a patient with rehabilitation training in two degrees of freedom: buckling and stretching. A control algorithm of the bidirectional driver is further provided to perform force control output for the driver, which may better help the patient recover hand functions.

1 Claim, 13 Drawing Sheets

(52) U.S. Cl.
CPC ..... *A61H 2201/165* (2013.01); *A61H 2201/1635* (2013.01); *A61H 2201/1659* (2013.01); *A61H 2201/5061* (2013.01); *A61H 2201/5071* (2013.01)

(58) Field of Classification Search
CPC ..... A61H 2201/165; A61H 2201/1659; A61H 2201/5061; A61H 2201/5071; A61H 1/0288; A61H 1/00; A61H 1/0237; A61H 3/00; B25J 9/0006; F15B 15/103

See application file for complete search history.

(56) References Cited

U.S. PATENT DOCUMENTS

| | | | | |
|---|---|---|---|---|
| 2015/0374575 | A1* | 12/2015 | Kamper | A61F 5/013 601/40 |
| 2017/0119614 | A1* | 5/2017 | Yeow | A61H 1/0288 |
| 2017/0266075 | A1* | 9/2017 | Becchi | A63B 23/16 |
| 2018/0079071 | A1* | 3/2018 | Griffith | A61H 1/0244 |
| 2018/0296419 | A1* | 10/2018 | Tong | B25J 9/0006 |
| 2018/0303698 | A1* | 10/2018 | Wijesundara | F15B 15/10 |
| 2019/0038222 | A1* | 2/2019 | Krimon | A61B 5/1107 |
| 2019/0209086 | A1* | 7/2019 | Huang | A61H 1/0288 |
| 2019/0336381 | A1* | 11/2019 | Koltzi | A61H 1/0285 |
| 2019/0374422 | A1* | 12/2019 | Yeow | A61H 1/006 |
| 2020/0324402 | A1* | 10/2020 | Roh | A61H 1/00 |
| 2020/0345574 | A1* | 11/2020 | San | A61H 1/0288 |
| 2021/0386615 | A1* | 12/2021 | Suarez | A61H 9/0092 |

FOREIGN PATENT DOCUMENTS

| | | | | |
|---|---|---|---|---|
| CN | 111067753 | A | 4/2020 | |
| CN | 111821144 | A | 10/2020 | |
| CN | 211797581 | U | * 10/2020 | |
| CN | 211797581 | U | 10/2020 | |
| CN | 112353642 | A | 2/2021 | |
| CN | 113491622 | A | 10/2021 | |
| WO | WO-2017120314 | A1 | * 7/2017 | A61B 17/135 |

* cited by examiner

METHOD FOR MANUFACTURING AND CONTROLLING REHABILITATION GLOVE BASED ON BIDIRECTIONAL DRIVER OF HONEYCOMB IMITATING STRUCTURE

TECHNICAL FIELD

The present invention belongs to the field of rehabilitation robots for exoskeletons of upper limbs, and particularly relates to a method for manufacturing and controlling a rehabilitation glove based on a bidirectional driver of a honeycomb imitating structure.

BACKGROUND

Hands are the most important limbs of human beings, which perform most daily activities in life, such as picking up objects, drinking water and greeting. Hand dysfunction induced by diseases such as stroke and Parkinson's disease affect normal life of patients severely. Traditional rehabilitation after disease is performed by rehabilitation physicians who help the patients realize action guidance and auxiliary movement of limbs. With aging of population in China, there are increasing patients suffering from stroke, and rehabilitation physicians are increasingly needed. Rehabilitation robots are a major means to relieve the rehabilitation problem.

A flexible exoskeleton rehabilitation robot that is a novel rehabilitation robot can help patients realize complicated rehabilitation movements and auxiliary functions in daily life, which is the hotspot of researches in recent years. Compared with a rigid robot, the flexible robot features high flexibility, good wearable performance, low cost and the like, and is regarded as a powerful means for the rehabilitation robot in the future. Some studies have been conducted based on the flexible rehabilitation robot, where patent CN111821144A provides an elliptical corrugated pipe bending actuator and a wearable finger buckling rehabilitation device. A driver is bent along an axis by inflating an elliptical corrugated pipe, and the driver is provided with an output force by means of stretchability of the corrugated pipe.

Patent CN112353642A provides a wearable soft rehabilitation glove with increased asymmetrical cavity contact. The patent increases an output force of a flexible driver as the upper and lower layers of a cavity are asymmetrical in width, and decreases the distance between air cavities by means of a contact pad, thereby increasing a grasping force output by the driver.

The above-mentioned patents output forces through expansion of the cavities and extrusion between the air cavities, and have some problems:

However, the above-mentioned patents also have some problems:

1. The driver is small in deformation and output force.

2. The output force of the rehabilitation device and the working space are insufficient, the air pressure required by the driver is large, and the air pressure borne by the driver is increased, which is likely to damage the driver.

SUMMARY

In order to solve the above-mentioned problems, the present invention discloses a method for manufacturing and controlling a rehabilitation glove based on a bidirectional driver of a honeycomb imitating structure, and provides a flexible bidirectional driver large in output force and small in required air pressure, which may provide patients with rehabilitation training in two degrees of freedom: buckling and stretching, thereby helping the patients recover hand functions as soon as possible.

To achieve the foregoing objective, the technical solutions of the present invention are as follows:

A rehabilitation glove based on a bidirectional driver of a honeycomb imitating structure includes five bidirectional drivers of the honeycomb imitating structure and a cotton glove, where the bidirectional drivers are fixed to a back of the glove through hook and loop fasteners.

Each of the bidirectional drivers includes a buckling air bag, a middle guide layer and a stretching air bag; the buckling air bag is in a continuous bent state, the middle guide layer is also in a continuous bent state, the buckling air bag and the middle guide layer are symmetrically arranged, and the stretching air bag in a straightened state is arranged below the middle guide layer.

The buckling air bag is formed by hot pressing an air nozzle I, an upper layer of the buckling air bag, a spacer layer of the air bag and a lower layer of the buckling air bag from top to bottom, and the stretching air bag is formed by hot pressing an air nozzle II, an upper layer of the stretching air bag, a spacer layer of the air bag and a lower layer of the stretching air bag from top to bottom.

The present invention may provide the patients with rehabilitation training in two degrees of freedom: buckling and stretching:

1. The driver stretches to be inflated and pressurized, so that the driver may be straightened to provide a finger of the patient with a stretching force.

2. The buckling air bag is inflated and pressurized, so that the bent part on the upper portion of the driver is straightened. Deformation of each honeycomb structure is overlapped, so that the bidirectional driver is bent to provide the finger of the patient with a buckling force.

The specific principle is as follows:

when the buckling air bag is inflated to expand, an upper portion $L_{FE}$ $L_{ED}$ and $L_{DG}$ of the honeycomb structure form a straight line $L_{FC}$ as a result of increase of air pressure to push the guide layers on two sides to bend towards two sides, and it is assumed that a length of the straight line of the driver is not changed due to the action of air pressure, a rotating angle is solved:

a vertical line $L_{GH}$ is made through a point C, a perpendicular foot is a point H, and $L_{DC}$ and $L_{BC}$ may be obtained:

$$L_{DC}=\sqrt{L_{DG}^2+L_{GC}^2}$$

$$L_{BC}=\sqrt{L_{BH}^2+L_{CH}^2}$$

where an initial included angle of $L_{DB}$ and $L_{BC}$ is:

$$\alpha_{DBC} = \arcsin\left(\frac{L_{BH}}{L_{BC}}\right)$$

an included angle of $L_{DB}$ and $L_{BC}$ after rotation is:

$$\beta_{DBC} = \arcsin\left(\frac{L_{DC}}{L_{BC}}\right)$$

as the air bags extrude each other in the inflating process, it is guaranteed that $\theta_{CBH}$ in the operating process is not changed, and the rotating angle of the single honeycomb structure is:

$$\Delta_{DBC}=\alpha_{DBC}-\beta_{DBC}$$

an output angle at a tail end of the bidirectional driver is:

$$\theta=2N^*\Delta_{DBC}$$

where N is a number of the honeycomb structures.

A control method of the bidirectional driver is as follows:

A control system of the single bidirectional driver is composed of the bidirectional driver, a force sensor a, a force sensor b, an air pressure sensor a, an air pressure sensor b, a proportional valve a, a proportional valve b, a control center and an air pump. The force sensor a is mounted in a part (above the tail end of the finger) of the tail end of the bidirectional driver in contact with a finger, the force sensor b is mounted in a finger pulp part (below the tail end of the finger) of the finger, the air bags, the air pressure sensors, the proportional valves and the air pump are connected through an air pipe, and the proportional valves are connected with a control center through a wire. The system is controlled by using a PID algorithm.

A value of the force sensor a is collected as $F_1$, a value of the force sensor b as $F_2$, a value of the air pressure sensor a as $P_1$, a value of the air pressure sensor b as $P_2$, a set value of the proportional valve a is $Set_1$, and a set value of the proportional valve b is $Set_2$.

when a movement is buckling, the driver uses the PID control algorithms of air pressure and force, an output force is set as $Set_{F1}$, a period used is T, and each of the PID control algorithms has three parameters $K_p$ $K_i$ $K_d$ needed to be adjusted; an output of the corresponding proportional valve is:

$$e_k = Set_{F1k} - F_{1k}$$

$$Set_{pk} = K_{p1}e_k + K_{i1}\sum_{j=0}^{k} e_j + K_{d1}\frac{e_k - e_{k-1}}{T}$$

$$\Delta_k = Set_{pk} - P_{1k}$$

$$Set_{1k} = K_{p2}\Delta_k + K_{i2}\sum_{j=0}^{k}\Delta_j + K_{d2}\frac{\Delta_k - \Delta_{k-1}}{T}$$

similarly, when the movement state is stretching, the driver uses the PID control algorithms of air pressure and force, an output force is set as $Set_{F2}$, and an output of the corresponding proportional valve is:

$$e_k = Set_{F2k} - F_{2k}$$

$$Set_{pk} = K_{p3}e_k + K_{i3}\sum_{j=0}^{k} e_j + K_{d3}\frac{e_k - e_{k-1}}{T}$$

$$\Delta_k = Set_{pk} - P_{2k}$$

$$Set_{2k} = K_{p4}\Delta_k + K_{i4}\sum_{j=0}^{k}\Delta_j + K_{d4}\frac{\Delta_k - \Delta_{k-1}}{T}.$$

Beneficial effects of the present invention are as follows:

1. Provided is a flexible glove based on a bidirectional driver. The glove based on the bidirectional driver may provide the patient with rehabilitation training in two degrees of freedom: buckling and stretching.

2. The driver is manufactured by using the honeycomb imitating structure, and the driver deforms by means of axial deformation of the air bag, so that a larger output force and a larger rotating angle may be generated.

3. A structural model of the bidirectional driver is established, and a mounting angle at the tail end of the driver may be calculated by determining parameters of the bidirectional driver.

4. A control algorithm of the bidirectional driver is designed, so as to control the output forces of the bidirectional driver in buckling and stretching directions, respectively.

Figure 1:
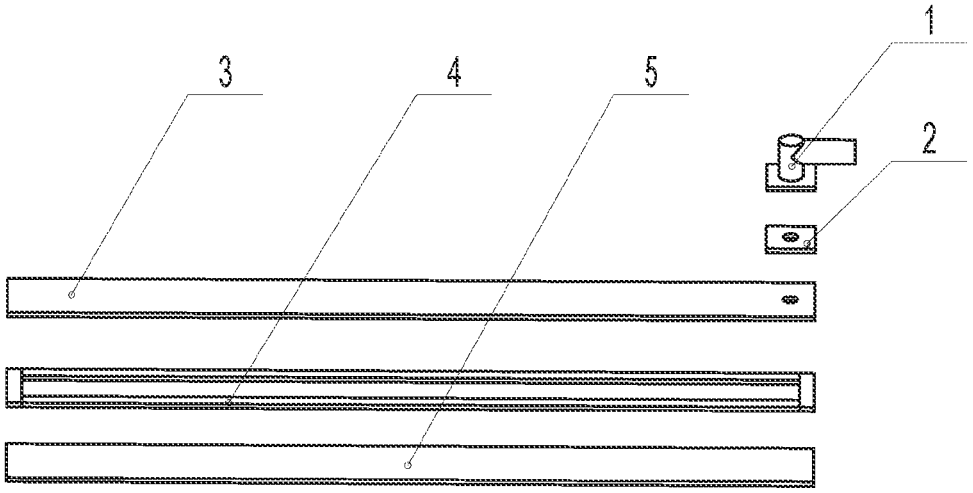
FIG. 1 is a schematic exploded diagram of an air bag of a driver of the present invention.
Figure 2:
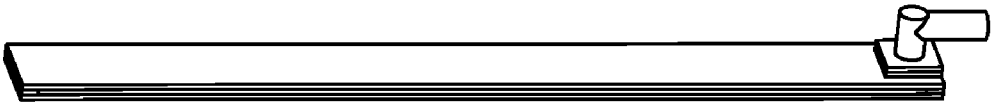
FIG. 2 is a schematic diagram of the air bag of the driver of the present invention.
Figure 3:
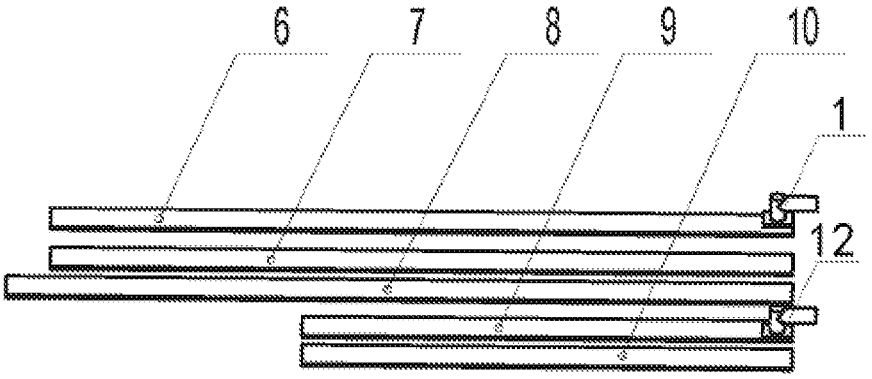
FIG. 3 is a schematic exploded diagram of the driver of the present invention.
Figure 4:
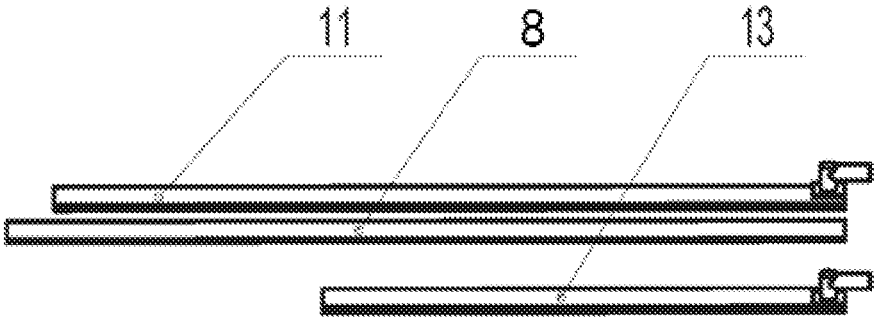
FIG. 4 is a schematic processing diagram 1 of the driver of the present invention.
Figure 5:
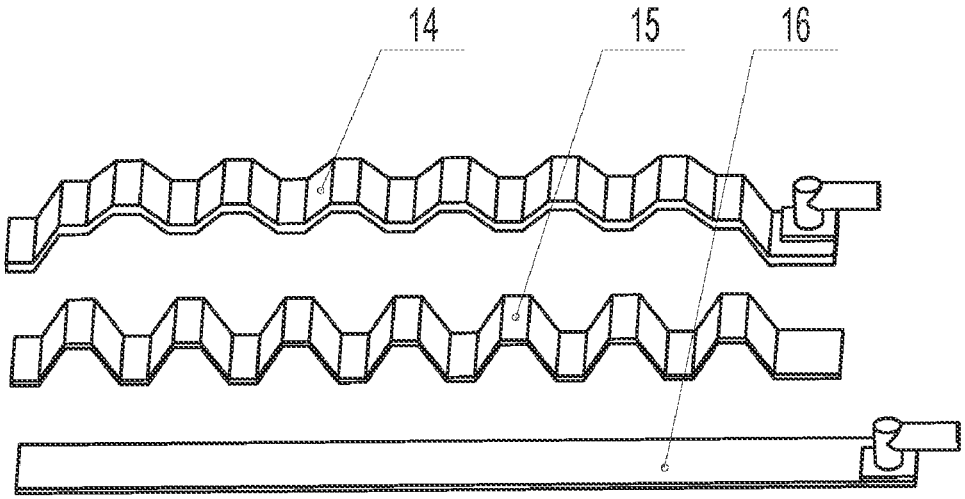
FIG. 5 is a schematic processing diagram 2 of the driver of the present invention.
Figure 6:
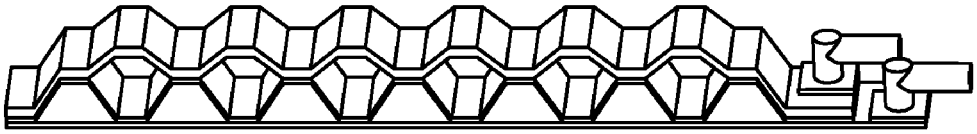
FIG. 6 is a schematic diagram of a stretched state of the driver of the present invention.
Figure 7:
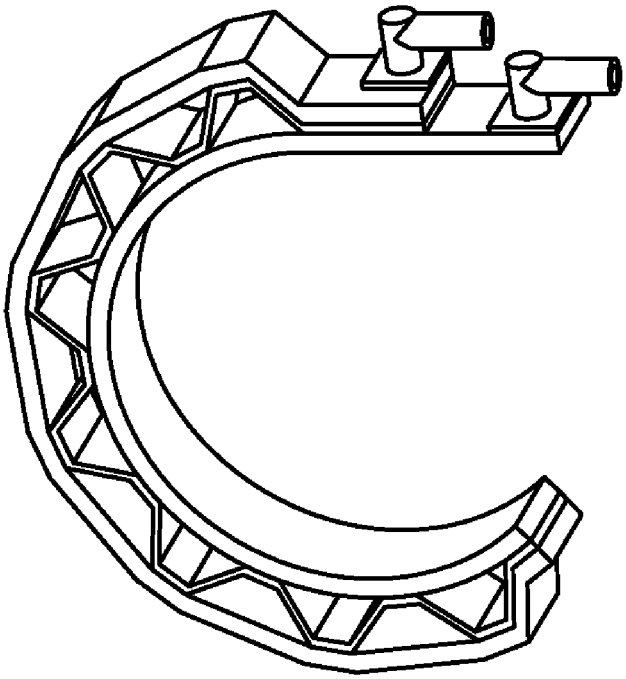
FIG. 7 is a schematic diagram of a buckled state of the driver of the present invention.
Figure 8:
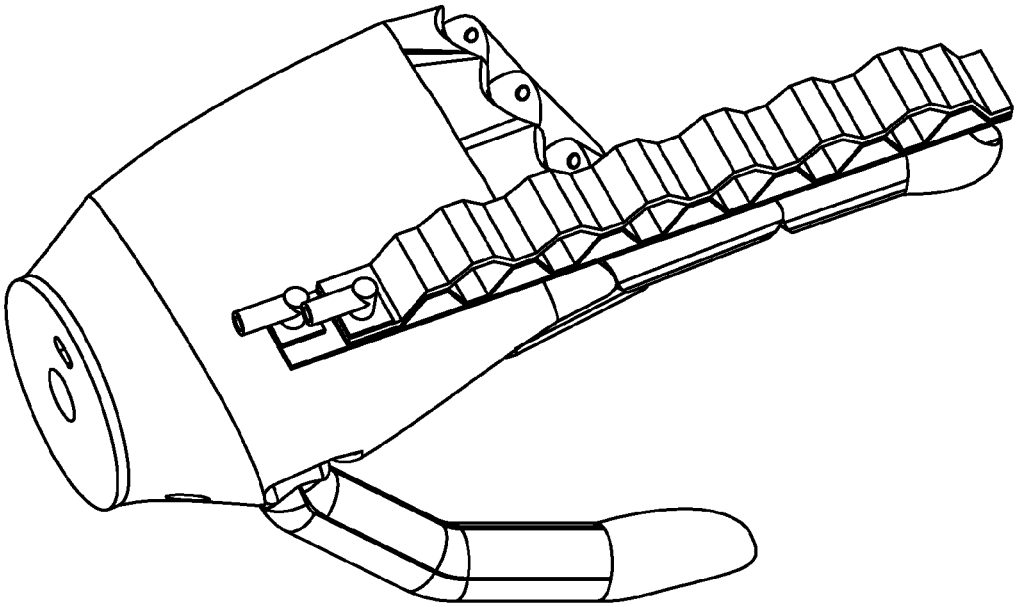
FIG. 8 is a schematic diagram of the stretched driver worn at the index finger of the present invention.
Figure 9:
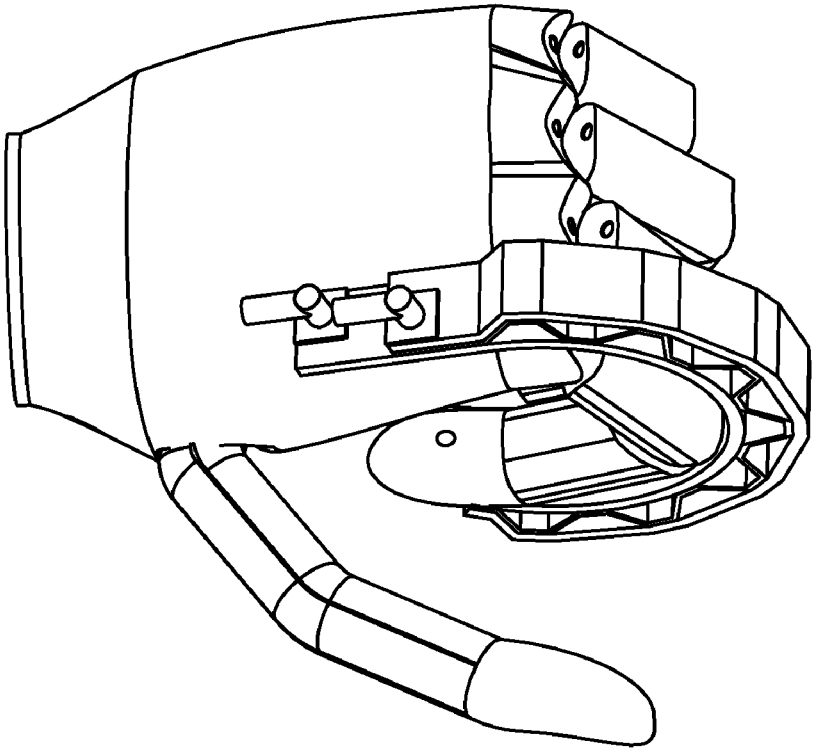
FIG. 9 is a schematic diagram of the buckled driver worn at the index finger of the present invention.
Figure 10:
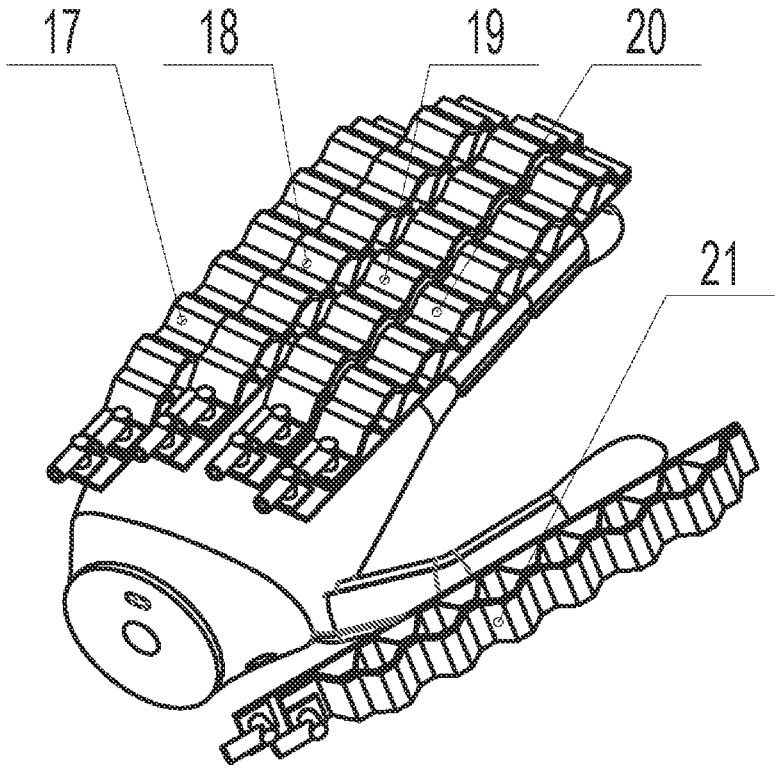
FIG. 10 is a schematic diagram of wearing the drivers at five fingers of the present invention.
Figure 11:
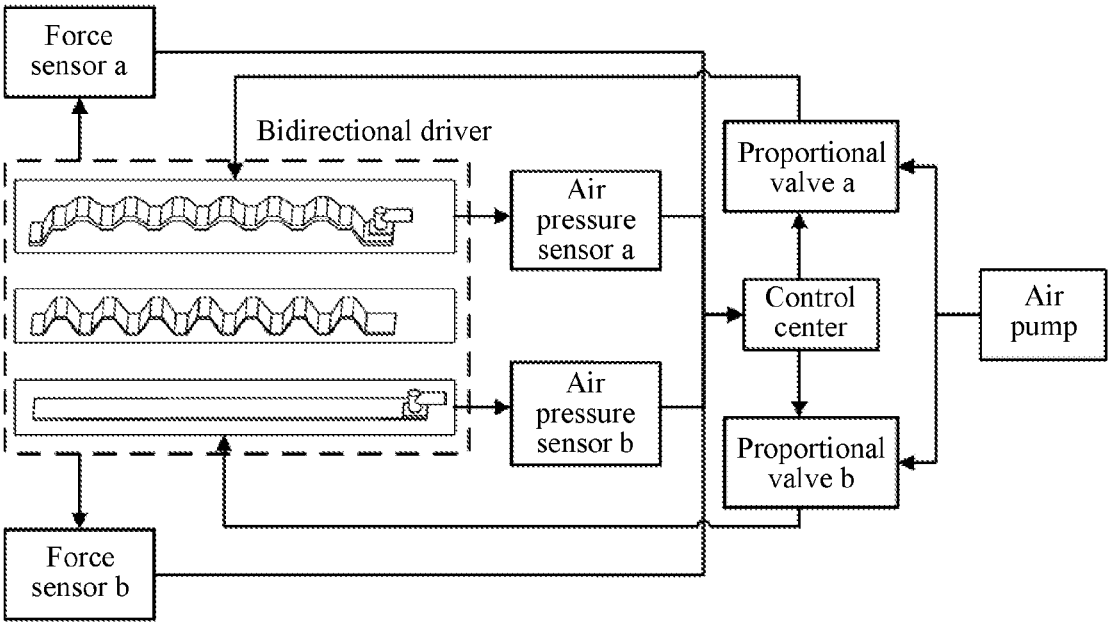
FIG. 11 is a schematic diagram of a functional block diagram of the present invention.
Figure 12:
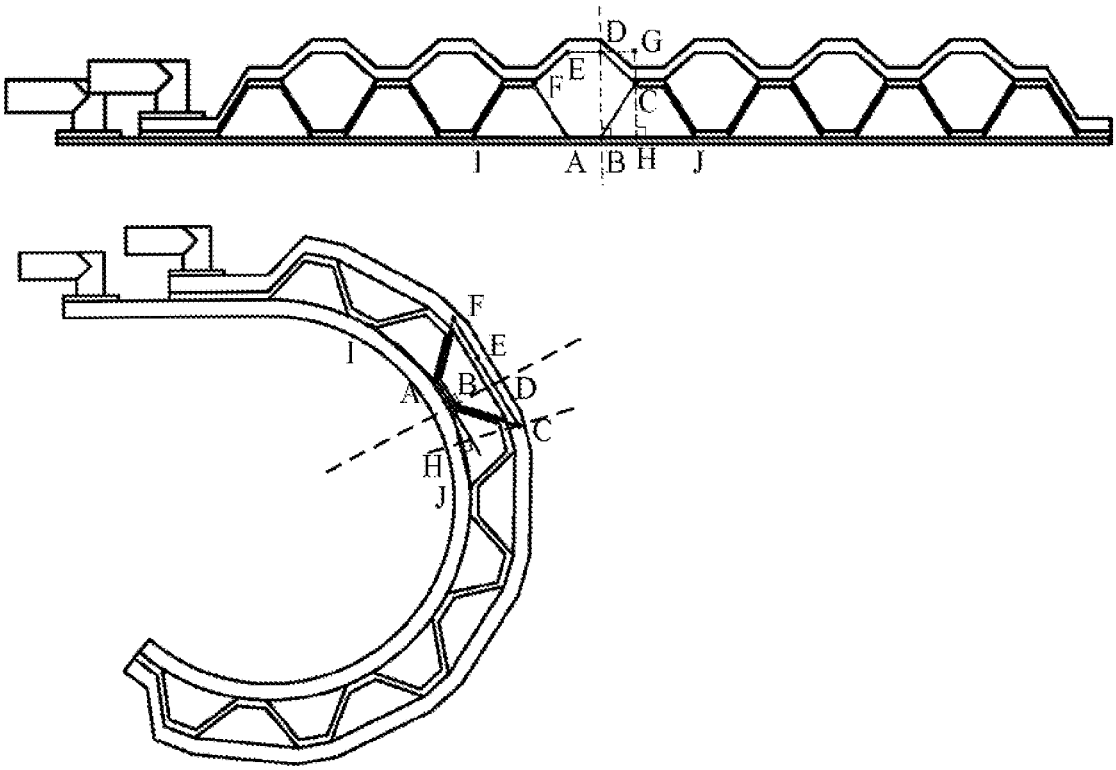
FIG. 12 is a schematic diagram of structural analysis of the present invention.
Figure 13:
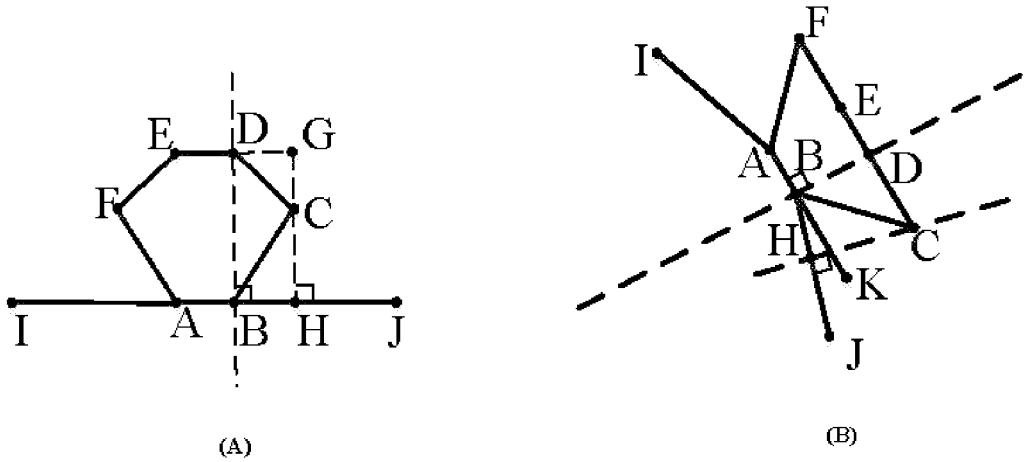
FIG. 13 is a simplified schematic diagram of structural analysis of the present invention.

In the drawings, 1—air nozzle I; 2—air nozzle bonding layer; 3—upper layer of air bag; 4—spacer layer of air bag; 5—lower layer of air bag; 6—upper layer of buckling air bag; 7—lower layer of buckling air bag; 8—middle guide layer; 9—upper layer of stretching air bag; 10—lower layer of stretching air bag; 11—buckling air bag; 12—air nozzle II; 13—stretching air bag; 14—bent state of buckling air bag; 15—bent state of middle guide layer; 16—straightened state of buckling air bag; 17—little finger driver; 18—third finger driver; 19—middle finger driver; 20—index finger driver; and 21—thumb driver.

DETAILED DESCRIPTION

The present invention is further described below with reference to the accompanying drawings and specific implementations. It should be understood that the specific implementations are merely used to describe the present invention but are not intended to limit the protection scope of the present invention.

As shown in figures, the rehabilitation glove based on a bidirectional driver of a honeycomb imitating structure disclosed by the present invention includes five bidirectional drivers of the honeycomb imitating structure and a cotton glove, where the bidirectional drivers are fixed to a back of the glove through hook and loop fasteners.

Each of the bidirectional drivers includes a buckling air bag 11, a middle guide layer 8 and a stretching air bag 13. The buckling air bag 11 is in a continuous bent state. The middle guide layer 8 is also in a continuous bent state. The buckling air bag 11 and the middle guide layer 8 are symmetrically arranged. The stretching air bag 13 in a straightened state is arranged below the middle guide layer 8, thereby forming a bidirectional driver of a honeycomb imitating structure.

The buckling air bag 11 is formed by hot pressing an air nozzle I 1, an upper layer 6 of the buckling air bag, a spacer layer 4 of the air bag and a lower layer 7 of the buckling air bag from top to bottom, and is hollow inside. The stretching air bag 13 is formed by hot pressing an air nozzle II 12, an upper layer 9 of the stretching air bag, a spacer layer 4 of the air bag and a lower layer 10 of the stretching air bag from top to bottom.

Each of the air bags is composed of the upper layer 3 of the air bag, the spacer layer 4 of the air bag, the lower layer 5 of the air bag and the air nozzle. The upper layer 3 of the air bag and the lower layer 5 of the air bag are composed of a fabric and a TPU material, and the TPU material may be melted via a hot press, so that multiple layers of TPU materials are processed and melted together. Similarly, through heating, the air nozzle and the upper layer of the air bag are heated and melted through the air nozzle bonding layer 2. The spacer layer 4 of the air bag is arranged between the upper layer 3 of the air bag and the lower layer 5 of the air bag. The spacer layer 4 of the air bag is of a hollow frame structure. The upper layer 3 of the air bag and the lower layer 5 of the air bag are subjected to hot pressing, so as to manufacture an air bag hollowed inside with the air nozzle.

The present invention may provide the patient with rehabilitation training in two degrees of freedom: buckling and stretching. The driver stretches to be inflated and pressurized, so that the driver may be straightened to provide the finger of the patient with a stretching force. The buckling air bag is inflated and pressurized, so that the bent part on the upper portion of the driver is straightened. Deformation of each honeycomb structure is overlapped, so that the bidirectional driver is bent to provide the finger of the patient with a buckling force.

The specific principle is as follows:

when the buckling air bag is inflated to expand, an upper portion $L_{FE}$, $L_{ED}$ and $L_{DG}$ of the honeycomb structure form a straight line $L_{FC}$ as a result of increase of air pressure to push the guide layers on two sides to bend towards two sides, and it is assumed that a length of the straight line of the driver is not changed due to the action of air pressure, a rotating angle is solved:

a vertical line $L_{GH}$ is made through a point C, a perpendicular foot is a point H, and $L_{DC}$ and $L_{BC}$ may be obtained:

$$L_{DC}=\sqrt{L_{DG}^2+L_{GC}^2}$$

$$L_{BC}=\sqrt{L_{BH}^2+L_{CH}^2}$$

where an initial included angle of $L_{DB}$ and $L_{BC}$ is:

$$\alpha_{DBC} = \arcsin\left(\frac{L_{BH}}{L_{BC}}\right)$$

an included angle of $L_{DB}$ and $L_{BC}$ after rotation is:

$$\beta_{DBC} = \arcsin\left(\frac{L_{DC}}{L_{BC}}\right)$$

as the air bags extrude each other in the inflating process, it is guaranteed that $\theta_{CBH}$ in the operating process is not changed, and the rotating angle of the single honeycomb structure is:

$$\Delta_{DBC}=\alpha_{DBC}-\beta_{DBC}$$

an output angle at a tail end of the bidirectional driver is:

$$\theta=2N*\Delta_{DBC}$$

where N is a number of the honeycomb structures.

Control Method:

A control system of the single bidirectional driver is composed of the bidirectional driver, a force sensor a, a force sensor b, an air pressure sensor a, an air pressure sensor b, a proportional valve a, a proportional valve b, a control center and an air pump. The force sensor a is mounted in a part (above the tail end of the finger) of the tail end of the bidirectional driver in contact with a finger, the force sensor b is mounted in a finger pulp part (below the tail end of the finger) of the finger, the air bags, the air pressure sensors, the proportional valves and the air pump are connected through an air pipe, and the proportional valves are connected with a control center through a wire. The system is controlled by using a PID algorithm.

A value of the force sensor a is collected as $F_1$, a value of the force sensor b as $F_2$, a value of the air pressure sensor a as $P_1$, a value of the air pressure sensor b as $P_2$, a set value of the proportional valve a is $Set_1$, and a set value of the proportional valve b is $Set_2$.

when a movement is buckling, the driver uses the PID control algorithms of air pressure and force, an output force is set as $Set_{F1}$, a period used is T, and each of the PID control algorithms has three parameters $K_p$ $K_i$ $K_d$ needed to be adjusted; an output of the corresponding proportional valve is:

$$e_k = Set_{F1k} - F_{1k}$$

$$Set_{pk} = K_{p1}e_k + K_{i1}\sum_{j=0}^{k} e_j + K_{d1}\frac{e_k - e_{k-1}}{T}$$

$$\Delta_k = Set_{pk} - P_{1k}$$

$$Set_{1k} = K_{p2}\Delta_k + K_{i2}\sum_{j=0}^{k}\Delta_j + K_{d2}\frac{\Delta_k - \Delta_{k-1}}{T}$$

similarly, when the movement state is stretching, the driver uses the PID control algorithms of air pressure and force, an output force is set as $Set_{F2}$, and an output of the corresponding proportional valve is:

$$e_k = Set_{F2k} - F_{2k}$$

$$Set_{pk} = K_{p3}e_k + K_{i3}\sum_{j=0}^{k} e_j + K_{d3}\frac{e_k - e_{k-1}}{T}$$

$$\Delta_k = Set_{pk} - P_{2k}$$

$$Set_{2k} = K_{p4}\Delta_k + K_{i4}\sum_{j=0}^{k}\Delta_j + K_{d4}\frac{\Delta_k - \Delta_{k-1}}{T}.$$

The flexible rehabilitation glove based on a bidirectional driver of a honeycomb imitating structure disclosed by the present invention provides a novel bidirectional driver of a honeycomb imitating structure. The five bidirectional drivers of the honeycomb imitating structure correspond to five fingers, respectively, and may provide the patient with rehabilitation training in two degrees of freedom: buckling and stretching. Control algorithms of the bidirectional drivers are provided to perform controlled output of forces of the drivers, thereby better helping the patient recover hand function as soon as possible.

Although exemplary implementations are illustrated and described in the present invention, a person skilled in the art should understand that various changes and modifications may be made to the present invention without departing from the scope defined by claims of the present invention.

What is claimed is:

1. A rehabilitation glove based on a bidirectional driver of a honeycomb imitating structure, comprising five bidirectional drivers of the honeycomb imitating structure and a cotton glove, wherein the bidirectional drivers are fixed to a back of the glove through hook and loop fasteners; each of the bidirectional drivers comprises a buckling air bag, a middle guide layer and a stretching air bag; the buckling air bag is in a continuous bent state, the middle guide layer is also in a continuous bent state, the buckling air bag and the middle guide layer are symmetrically arranged, and the stretching air bag in a straightened state is arranged below the middle guide layer; and the buckling air bag is formed by hot pressing an air nozzle I, an upper layer of the buckling air bag, a spacer layer of the air bag and a lower layer of the buckling air bag from top to bottom, and the stretching air bag is formed by hot pressing an air nozzle II, an upper layer of the stretching air bag, a spacer layer of the air bag and a lower layer of the stretching air bag from top to bottom; and wherein a specific principle of the bidirectional driver is as follows: the bidirectional driver of the honeycomb imitating structure is formed by connecting several driving units successively, each of the driving units comprising a semi-hexagon and a hexagon that are adjacent; the middle guide layer and the stretching air bag form the semi-hexagon, the semi-hexagon taking the longest edge as a bottom; the buckling air bag and the middle guide layer form a hexagon, the hexagon taking an edge as a bottom; to facilitate analysis, the hexagon in one driving unit is named: six vertexes of the hexagon are anticlockwise named points A, B, C, D, E and F by taking a vertex at the left bottom of the hexagon as a starting point, wherein AB is a bottom edge, ED is a top edge, F is a left vertex of the hexagon, and C is a right vertex of the hexagon; when the buckling air bag is inflated to expand, in a moving process of the bidirectional driver, a deformation degree of each of the driving units is same; by taking a single driving unit as an example, an FE edge, the ED edge and a DC edge of an upper portion of the hexagon in the driving unit form a straight line FC edge as a result of increase of air pressure; the guide layers on two sides are pushed to bend towards two sides, and it is assumed that a straight line length of the bidirectional driver is not changed due to the action of air pressure, a rotating angle is solved: vertical lines GH are respectively made towards the straight line where the edge AB and the edge ED are located through the right vertex C of the hexagon, perpendicular feet are respectively point H and point C, and lengths of the edge DC and the edge BC are respectively LDC and LBC, obtained by a trigonometric function:

$$L_{DC}=\sqrt{L_{DG}^2+L_{GC}^2}$$

$$L_{BC}=\sqrt{L_{BH}^2+L_{CH}^2}$$

wherein, a vertical line DB is made towards the straight line where the edge AB is located through a point D, a perpendicular foot is a point B, and an initial included angle between a line segment DB and a line segment BC is: $\alpha_{DBC}$ is obtained by a trigonometric function:

$$\alpha_{DBC} = \arcsin\left(\frac{L_{BH}}{L_{BC}}\right)$$

an included angle between the line segment DB and the line segment BC after rotation is ${}_{B}D_{BC}$, and it is obtained by the trigonometric function:

$$\beta_{DBC} = \arcsin\left(\frac{L_{DC}}{L_{BC}}\right)$$

as the air bags extrude each other in the inflating process, the shapes of the middle guide layer and the stretching air bag are not changed, thereby guaranteeing that the included angle ${}^{0}{}_{CBH}$ between the edge AB and the edge BC is unchanged in the moving process, and therefore, the rotating angle $\Delta_{DBC}$ of the single driving unit is represented as:

$$\Delta_{DBC}=\alpha_{DBC}-\beta_{DBC}$$

the output angle θ at a tail end of the bidirectional driver is:

$$\theta=2N*\Delta_{DBC}$$

wherein N is a number of hexagons in the bidirectional driver.

* * * * *